US005622454A

United States Patent [19]

Ashmore et al.

[11] Patent Number: 5,622,454

[45] Date of Patent: Apr. 22, 1997

[54] ANCHOR BOLT FOR STABILIZING ROCK STRATA AND METHOD OF INSTALLING

[75] Inventors: Peter S. Ashmore; John M. Walton, both of Doncaster, United Kingdom

[73] Assignee: Bridon PLC, United Kingdom

[21] Appl. No.: 446,597

[22] PCT Filed: Sep. 19, 1994

[86] PCT No.: PCT/GB94/02031

§ 371 Date: Jun. 23, 1995

§ 102(e) Date: Jun. 23, 1995

[87] PCT Pub. No.: WO95/08695

PCT Pub. Date: Mar. 30, 1995

[30] Foreign Application Priority Data

Sep. 20, 1993 [GB] United Kingdom ..... 9319414

[51] Int. Cl.[6] ..... E21D 20/02; E21D 21/00

[52] U.S. Cl. ..... 405/259.5; 405/302.2

[58] Field of Search ..... 405/259.5, 320.2

[56] References Cited

U.S. PATENT DOCUMENTS

| | | | |
|---|---|---|---|
| 4,360,292 | 11/1982 | Keeler et al. | 405/259.5 |
| 4,576,524 | 3/1986 | Heintzmann et al. | 405/259.5 |
| 4,850,746 | 7/1989 | Finsterwalder et al. | 405/259.5 |
| 4,904,122 | 2/1990 | Herbst et al. | 405/259.5 |

FOREIGN PATENT DOCUMENTS

| | | | |
|---|---|---|---|
| 1536012 | 1/1990 | U.S.S.R. | 405/259.5 |

*Primary Examiner*—David J. Bagnell
*Attorney, Agent, or Firm*—Cesari and McKenna

[57] ABSTRACT

A thrust plate which bears on a rock face is connected to a load-bearing termination on one end portion of an elongate member, e.g., a hollow rope, extending along a hole bored into the rock. An anchorage medium fills the hole, anchoring the elongate member in the rock, and extends between the end portion and the surrounding portion of the termination, securing these two portions together.

12 Claims, 2 Drawing Sheets

ANCHOR BOLT FOR STABILIZING ROCK STRATA AND METHOD OF INSTALLING

This invention relates to roof bolts, which are tensile reinforcing members used for stabilizing rock strata.

In particular the invention relates to a roof bolt of the type comprising an elongate member extending along a hole bored into a body of rock from a rock face, a load-bearing termination on one end portion of the elongate member, the termination lying partly inside and partly outside the hole, a thrust plate which bears on the rock face and which is connected to the termination, and an anchorage medium substantially filling the hole so as to anchor the elongate member in the body of rock.

A roof bolt of the above-described type is disclosed in GB-A-2 262 970 and corresponding U.S. Pat. No. 5,458,442, in which the termination is a ductile steel cylindrical fitting pressed or swaged onto the end portion of a flexible elongate member in the form of a hollow rope. The termination has an external screwthread for receiving a nut which acts on the thrust plate for tensioning purposes. However, the fixed termination allows only limited adjustment of the position of the thrust plate, once the elongate member has been introduced into the hole.

The present invention provides a roof bolt of the above-described type, in which the anchorage medium extends between the end portion of the elongate member and a surrounding portion of the termination and anchors the said portions to each other.

The invention also provides a method of installing a roof bolt, comprising boring a hole into a body of rock from a rock face; inserting an elongate member into the hole; inserting a termination partly into the hole so that a portion of the termination surrounds an end portion of the elongate member, a thrust plate connected to the termination being arranged to bear on the rock face; and injecting a settable anchorage medium into the hole so that the anchorage medium penetrates between the end portion of the elongate member and the surrounding portion of the termination.

If necessary, the end of the elongate member may be cropped after it has been inserted in the hole but before the termination is fitted. The termination can then be offered up into the hole, effectively sealing it, and the settable anchoring medium can be injected through the termination.

The elongate member may be a hollow rope, as described in GB-A-2 262 970, and U.S. Pat. No. 5,458,442, or may be one of the ribbed flexible members described in the specification of our co-pending applications GB 9317017.3, filed 16 Aug. 1993 (published as GB-A-2 281 366 on 1 Mar. 1995), and PCT/GB 94/01726, filed 5 Aug. 1994 (published as WO 95/05526 on 23 Feb. 1995). These applications correspond to pending U.S. application Ser. No. 08/424,317, filed Jul. 26, 1995.

Figure 1:
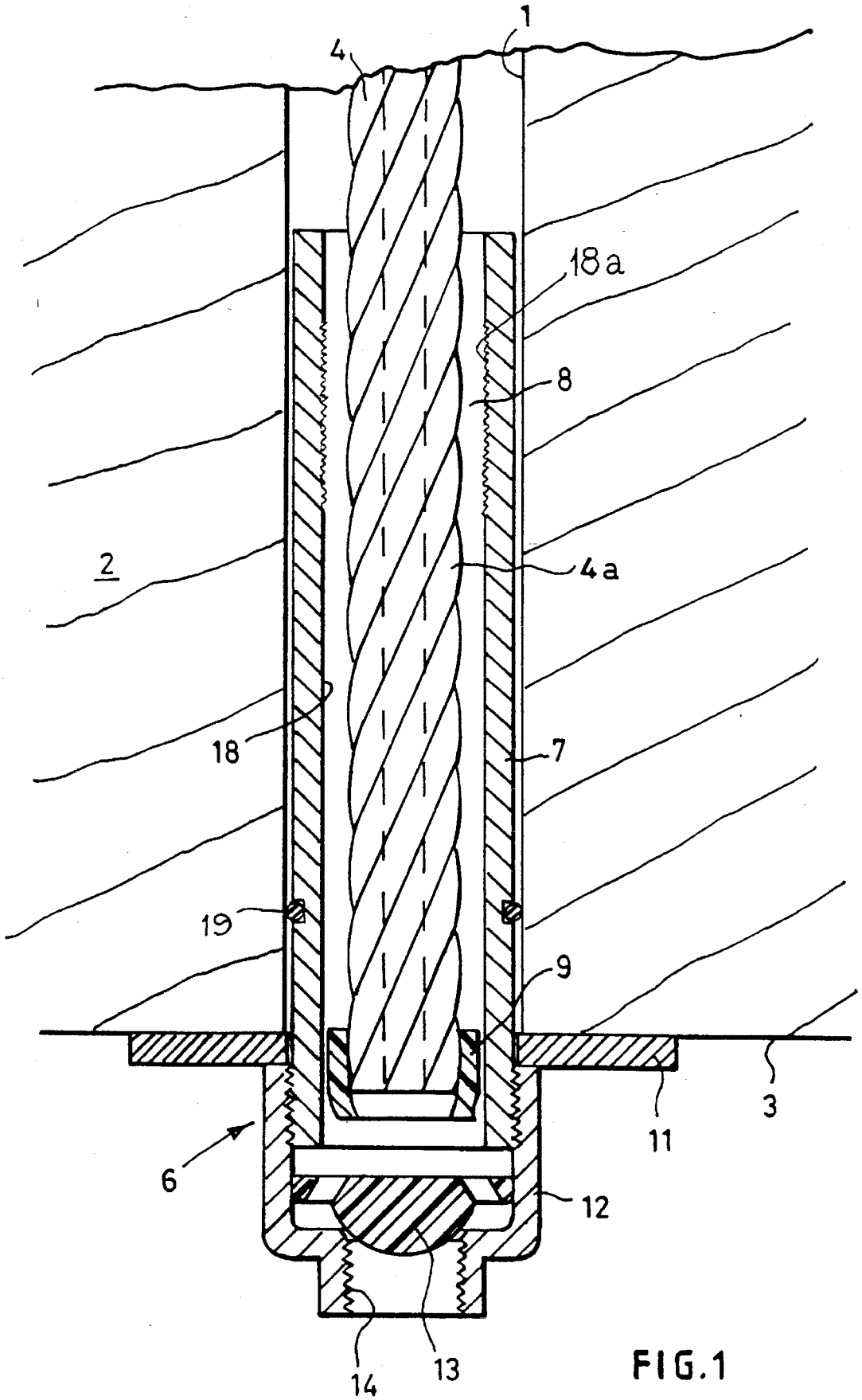
Figure 2:
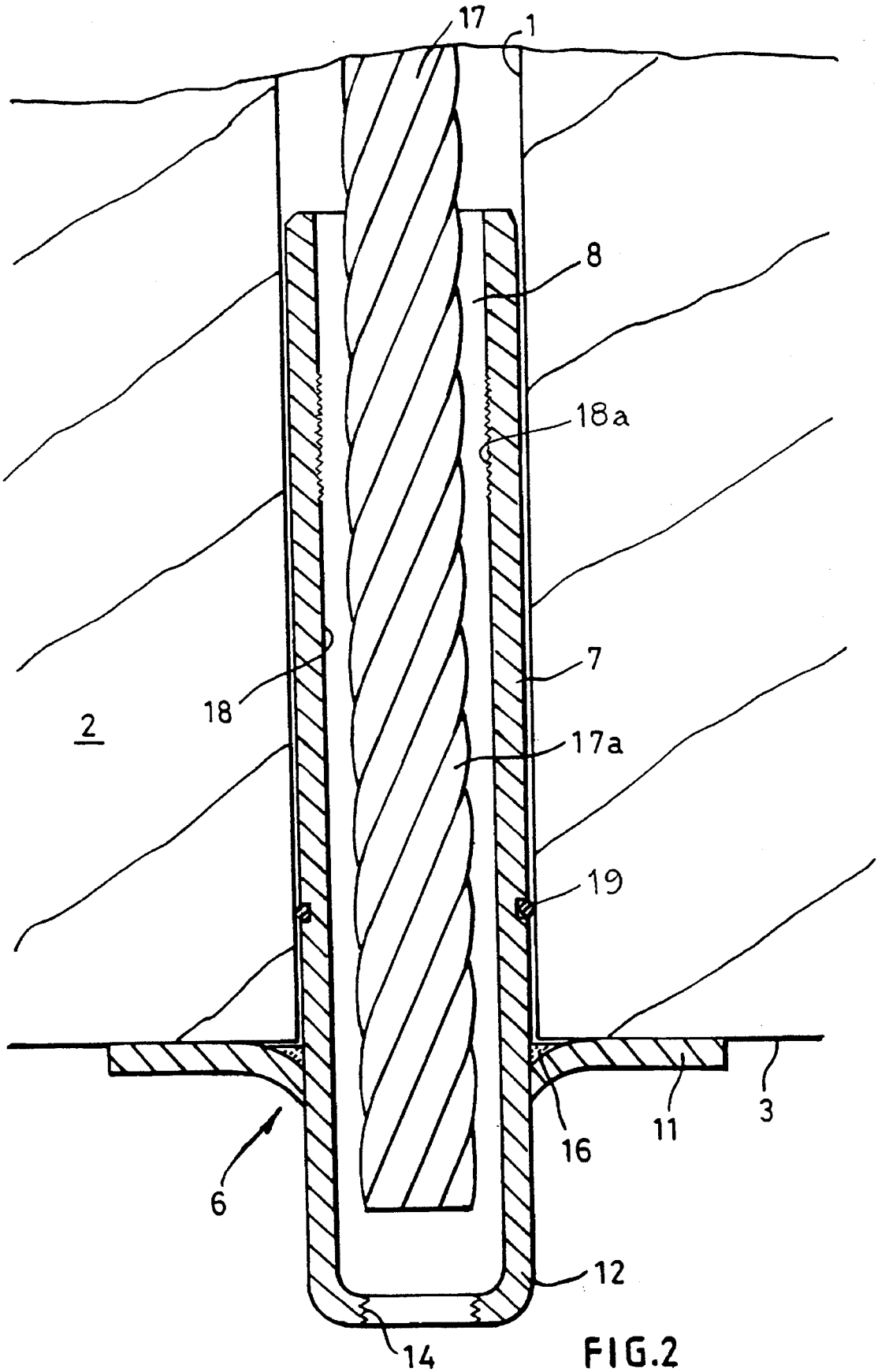

The invention will be described further, by way of example, with reference to the accompanying drawings, in which:

FIG. 1 is an axial cross-section through a first embodiment of a roof bolt, before injection of an anchorage medium; and FIG. 2 is a similar view of a second embodiment.

Referring firstly to FIG. 1, a hole 1 (e.g. 6 m long) is bored into a body of rock 2, from a rock face 3 forming the roof or wall of a tunnel. An elongate member 4 in the form of a hollow (coreless) steel wire rope is then inserted into the hole 1 so that only a few centimeters of rope project beyond the face 3; if necessary, the rope is cropped (i.e. excess rope is cut off) after insertion.

A termination 6 is then provided on the end of the rope 4. The termination 6 comprises an anchor tube 7 which fits in the hole 3 and surrounds an end portion 4*a* of the rope, leaving a free space 8. An optional guide sleeve 9 on the end of the rope 4 ensures that the end portion 4*a* is approximately co-axial with the anchor tube 7. Part of the tube 7 projects beyond the rock face 3 and is loosely surrounded by a (square) washer or thrust plate 11 which rests on the rock face. The plate 11 is connected to the tube 7 by a cap 12 which is screwed onto the end of the tube 7 and which contains an optional non-return valve 13.

The cap 12 has an inlet port 14 through which a settable anchorage medium (e.g. a resin or a cementitious grout) is injected (via the valve 13). The sleeve 9 partially obstructs direct flow into the space 8, so the medium flows preferentially through the hollow of the rope 4 and then back along the hole 1 until the space 8 is filled. When the anchorage medium sets, it anchors the rope 4 to the body of the rock 2 and anchors the termination 6 to the end portion 4*a* of the rope.

In the second embodiment, shown in FIG. 2, the elongate member 17 is a steel wire strand or rope (e.g. an indented strand as described in GB 9317017.3 and PCT/GB 94/01726) and U.S. Ser. No. 08/424,317 and the cap 12 with the inlet port 14 is an integral extension of the anchor tube 7, which surrounds an end portion 17*a* of the elongate member, leaving a space 8 to be filled with the anchorage medium. In this embodiment, the thrust plate 11 is fixed to the tube 7 by a weld 16.

In both embodiments, the inner surface 18 of the anchor tube 7 may be roughened as at 18*a* to enhance the connection between the tube 7 and the anchorage medium. The tube 7 may have at least one circumferential external groove (as shown) for accommodating an annular member 19, such as an O-ring or a circlip, to provide temporary sealing and anchorage in the hole 1 while the anchorage medium is in its flowable state.

We claim:

1. A roof bolt comprising an elongate member extending along a hole bored into a body of rock from a rock face, a load-bearing termination on one end portion of the elongate member, the termination lying partly inside and partly outside the hole, a thrust plate which bears on the rock face and which is connected to the termination and a settable anchorage medium which substantially fills the hole so as to anchor the elongate member in the body of rock and wherein the anchorage medium extends between the end portion of the elongate member and a surrounding portion of the termination and connects the said portion to each other.

2. A roof bolt as claimed in claim 1, in which the termination has an internal surface which is roughened to enhance the connection between the termination and the anchorage medium.

3. A roof bolt as claimed in claim 1, in which the elongate member is a strand or rope.

4. A roof bolt as claimed in claim 1, in which the elongate member is hollow.

5. A roof bolt as claimed in claim 1, in which the termination has a cap outside the hole, the cap having an inlet port for injection of the anchorage medium.

6. A roof bolt as claimed in claim 5, in which the cap contains a non-return valve.

7. A roof bolt as claimed in claim 1, including a guide locating the end portion of the elongate member approximately coaxial with the termination.

8. A roof bolt as claimed in claim 7, in which the guide comprises a sleeve on the end of the elongate member.

9. A roof bolt as claimed in claim 1, in which the termination has at least one circumferential external groove accommodating an annular sealing and anchorage member in the hole.

10. A roof bolt as claimed in claim 1, in which the anchorage medium is a resin or a cementitious grout.

11. A method of installing a roof bolt, comprising boring a hole into a body of rock from a rock face; inserting an elongate member into the hole; inserting a termination partly into the hole so that a portion of the termination surrounds an end portion of the elongate member, a thrust plate connected to the termination being arranged to bear on the rock face; and injecting a settable anchorage medium into the hole so that the anchorage medium penetrates between the end portion of the elongate member and the surrounding portion of the termination.

12. A method as claimed in claim 11, including cropping the end of the elongate member after it has been inserted in the hole.

* * * * *